US007148771B2

(12) United States Patent
Lamont

(10) Patent No.: US 7,148,771 B2
(45) Date of Patent: Dec. 12, 2006

(54) CONCENTRIC, TWO STAGE COARSE AND FINE TUNING FOR CERAMIC RESONATORS

(75) Inventor: Gregory J. Lamont, Jackson, NJ (US)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 11/018,172

(22) Filed: Dec. 21, 2004

(65) Prior Publication Data

US 2006/0132263 A1 Jun. 22, 2006

(51) Int. Cl.
*H01P 7/10* (2006.01)

(52) U.S. Cl. ..... 333/235

(58) Field of Classification Search ..... 333/202, 333/219.1, 232, 235
See application file for complete search history.

(56) References Cited

U.S. PATENT DOCUMENTS

| | | | | |
|---|---|---|---|---|
| 3,573,666 | A | | 4/1971 | Caffrey |
| 3,811,101 | A | | 5/1974 | Karp |
| 4,066,988 | A | | 1/1978 | Karp |
| 4,728,913 | A | * | 3/1988 | Ishikawa et al. ..... 333/235 |
| 4,769,620 | A | | 9/1988 | Nicotra |
| 4,862,111 | A | * | 8/1989 | Mettoudi et al. ..... 331/96 |
| 5,235,294 | A | * | 8/1993 | Ishikawa et al. ..... 333/17.1 |
| 5,323,129 | A | * | 6/1994 | Harris ..... 333/219.1 |
| 5,677,653 | A | | 10/1997 | Sarkka |
| 5,712,606 | A | * | 1/1998 | Sarkka ..... 333/219.1 |
| 5,825,267 | A | * | 10/1998 | Smith ..... 333/235 |
| 6,255,919 | B1 | | 7/2001 | Smith |
| 6,255,922 | B1 | | 7/2001 | Malmstrom et al. |
| 6,323,746 | B1 | | 11/2001 | Prager et al. |
| 6,362,707 | B1 | | 3/2002 | Reinhardt |
| 6,362,708 | B1 | | 3/2002 | Woods |
| 2003/0016099 | A1 | | 1/2003 | Manseau et al. |
| 2003/0098755 | A1 | | 5/2003 | Basawapatna et al. |

* cited by examiner

*Primary Examiner*—Seungsook Ham
(74) *Attorney, Agent, or Firm*—TThomas C. Geilenthien; Brake Hughes PLC; V. Lawrence Sewell

(57) ABSTRACT

A resonator assembly is provided. The resonator assembly includes a conductive housing defining a cavity, and a resonator. The resonator is disposed within the cavity and has a longitudinal bore. A first tuning assembly has a longitudinal bore and is movably disposed along the bore of the resonator. A second tuning assembly is movably disposed along the bore of the first tuning assembly.

14 Claims, 5 Drawing Sheets

CONCENTRIC, TWO STAGE COARSE AND FINE TUNING FOR CERAMIC RESONATORS

BACKGROUND OF THE INVENTION

1. Field of the Invention

This invention relates to cavity resonators and filters. More specifically, this invention relates to tunable resonators, and to filters incorporating tunable resonators.

2. Related Art

Tunable resonators are commonly used in filters and other devices that receive and transmit microwave communication signals. Such resonators are generally used in microwave filters having single or multiple resonators. In operation, the resonators are individually tuned to operate at a specific channel band within a broad range of frequencies and bandwidths. Tuning a conventional resonator may be accomplished by adjusting the position of a dielectric tuning slug with respect to a primary resonator disposed within the tunable resonator. However, practical applications of resonators are constrained by the resonators' tuning range. Although the tunable range of a tunable resonator can be relatively large, the individual channel bands are relatively small, and have a small spacing between adjacent channel bands. Consequently, the resonators must be precisely tuned so that neighboring channels do not interfere with one another during operation.

Tuning resonators over a wide range can be accomplished by adjusting the position of the tuning slug disposed adjacent the primary resonator. Specifically, the tuning slug's position is adjusted until the primary resonator reaches a desired resonant frequency. Tuning a conventional loaded resonator is discussed below with reference to FIG. 1. As shown, a conventional resonator 1 includes a housing 2, a ceramic primary resonator 3, and a ceramic tuning slug 4. To tune the resonator 1, the tuning slug 4 is moved relative to the primary resonator 3. For example, when the tuning slug 4 is moved closer to the primary resonator 3, the resonant frequency decreases. As the tuning slug 4 is moved further from the primary resonator 3, the resonant frequency increases. The tuning slug 4 is relatively large and is directly related to the tuning sensitivity. Additionally, the change in resonant frequency is nonlinear in relation to the change in position of the tuning slug 4. Thus, any movement of the tuning slug 4 will have a relatively large impact on the resonant frequency.

In practice, it is difficult to use a single stage ceramic resonator to tune over a large frequency range, yet still have enough accuracy to precisely tune into individual channels. One way of exerting control during tuning is to use a coarse adjustment mechanism for adjusting the tuning slug over a wide tuning range, and a fine adjustment mechanism for adjusting the tuning slug over a narrow tuning range. Conventional fine adjustment mechanisms often incorporate a finely threaded tuning shaft that is rotated to advance or retreat the tuning slug a relatively small distance within the cavity, and a locking mechanism for locking the tuning slug at a desired location. However, because the tuning slug is relatively large, even small movements of the tuning slug caused by the fine adjustment mechanism may be too coarse for a desired tuning operation. Further, manipulating the locking mechanism to lock the tuning slug may cause the tuning shaft to move the tuning slug a sufficient distance to degrade the tuning performance.

At present, precisely tuning resonators requires laborious manufacturing processes that increase the resonator's manufacturing costs. The costs of filters and other devices employing the resonators are also increased. Thus, a need exists for a tuning mechanism that can easily, reliably and accurately tune a resonator.

SUMMARY OF THE INVENTION

In a first aspect of the present invention, a resonator assembly is provided. The resonator assembly includes a conductive housing defining a cavity, and a resonator disposed within the cavity and having a longitudinal bore. A first tuning assembly is also provided and has a longitudinal bore and is movably disposed along the bore of the resonator. A second tuning assembly is movably disposed along the bore of the first tuning assembly.

In another aspect of the present invention, a resonator assembly is provided. The resonator assembly includes a conductive housing defining a cavity, and resonator means for resonating at a predetermined frequency disposed within the cavity. First tuning means for tuning the resonator means is provided and has an axis, and the first tuning means is movable with respect to the resonator means. Second tuning means for tuning the resonator means is movably disposed co-axially with the first tuning means.

In yet another aspect of the present invention, a filter is provided. The filter includes at least one resonator assembly, the resonator assembly having a conductive housing defining a cavity. A resonator is disposed within the cavity and has a longitudinal bore. A first tuning assembly has a longitudinal bore, and the first tuning assembly is movably disposed along the bore of the resonator. A second tuning assembly is movably disposed along the bore of the first tuning assembly.

In a further aspect of the present invention, a communication system is provided. The communication system includes communication equipment for performing at least one of sending and receiving a communication signal, and at least one filter. The filter includes at least one resonator assembly. The resonator assembly includes a conductive housing defining a cavity, and a resonator disposed within the cavity and having a longitudinal bore. A first tuning assembly is provided and has a longitudinal bore. The first tuning assembly is movably disposed along the bore of the resonator, and a second tuning assembly is movably disposed along the bore of the first tuning assembly.

These and other objects, aspects, features and advantages of the present invention will become apparent from the following detailed description of the preferred embodiments taken in conjunction with the accompanying drawings.

DETAILED DESCRIPTION

Preferred embodiments of the present invention provide for easy, reliable, and accurate tuning of a resonator. As discussed below in detail, the invention encompasses a resonator having at least two adjustable tuning slugs. Of course, the invention is not limited solely to the specific embodiments and features described below, and the embodiments and features discussed below may be modified without departing from the present invention.

Figure 1:
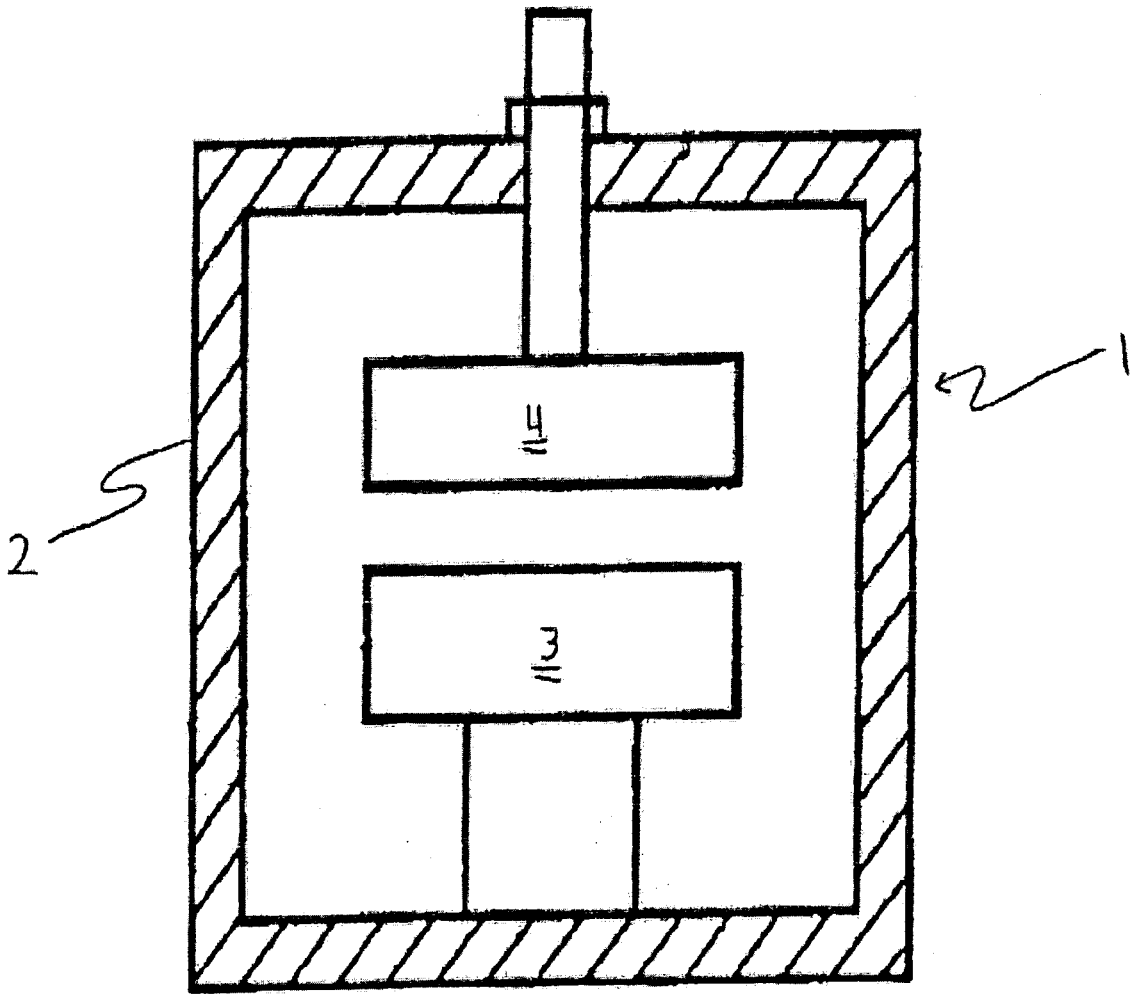
FIG. 1 Prior Art
FIG. 1 is a plan view of a resonator.
Figure 2:
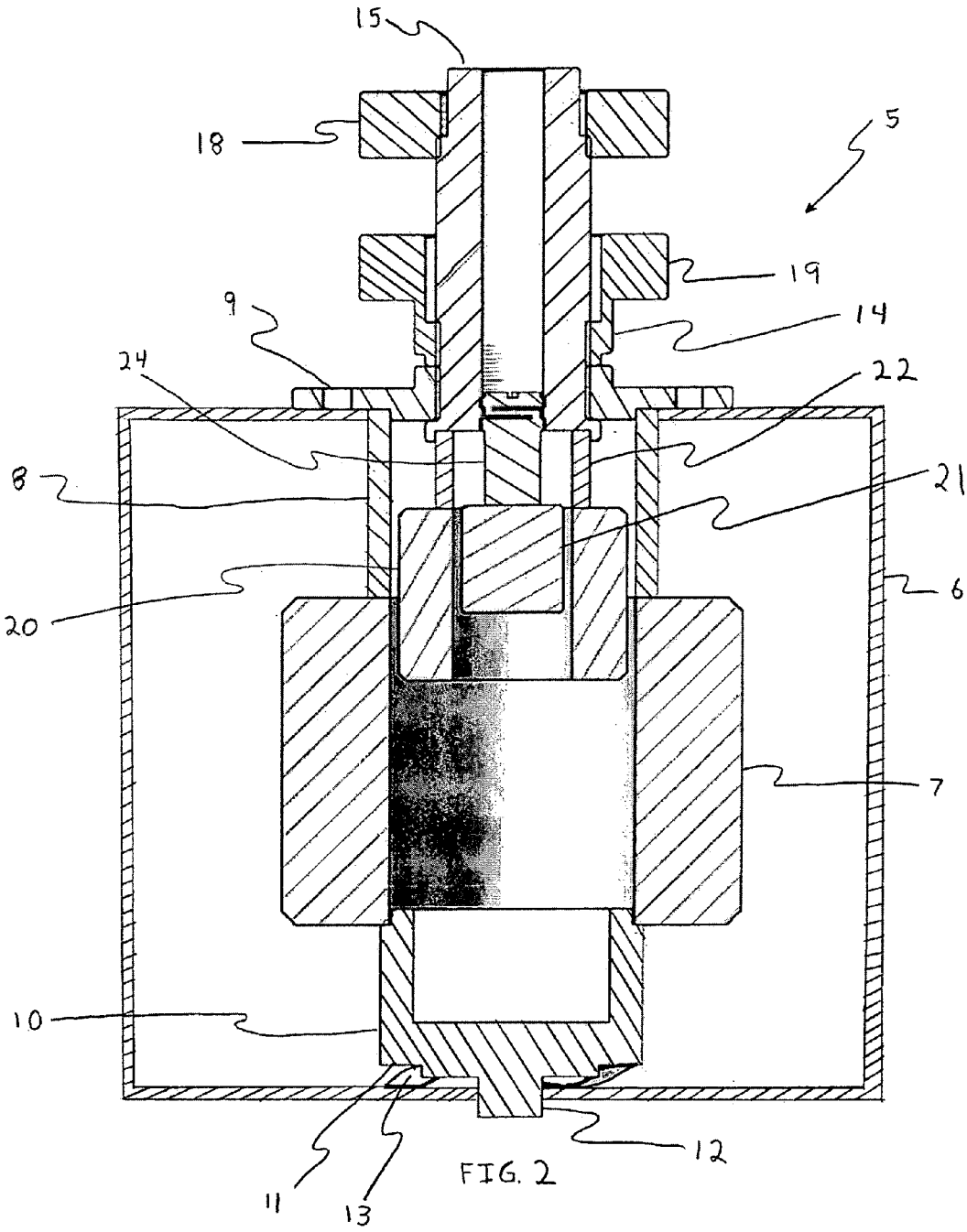
FIG. 2 is a plan view of a resonator assembly constructed in accordance with a preferred embodiment of the present invention.

A preferred embodiment of the present invention includes the resonator assembly 5 shown in FIG. 2. The resonator assembly 5 includes a conductive housing 6 defining an internal cavity, a main dielectric body 7 disposed within the cavity, and a top support structure 8 adapted to support the main dielectric body 7. The main dielectric body 7 is a substantially cylindrical ring-shaped dielectric resonator, having a centrally located longitudinal bore. The top support structure 8 is cylindrical with a longitudinal bore disposed co-axially with the bore of the main dielectric body 7. One end of the top support structure 8 is bonded to the main dielectric body 7, while the other end of the top support structure 8 is bonded to a bushing 9 anchored to the conductive housing 6. The bushing 9 is described later in detail.

The resonator assembly 5 further includes a bottom support structure 10. The bottom support structure 10 is a cylindrically shaped unit having a longitudinal bore with an enclosed end 11 from which a projection 12 extends. The projection 12 extends through a corresponding hole in the conductive housing 6, and cooperates with a spring 13 to help secure the bottom support structure 10 in place. Specifically, the spring 13 is placed in compression between the enclosed end 11 of the bottom support structure 10 and the conductive housing 6. By this arrangement the conductive housing 6, top support structure 8, bottom support structure 10 and spring 13 cooperate to firmly hold the main dielectric body 7 in position. The top support structure 8, bottom support structure 10 and spring 13 thereby prevent unwanted movement of the main dielectric body 7, and resist dimensional changes of the foregoing elements due to thermal variations.

In the preferred embodiment, the housing 6 is constructed of a metallic material, although any other suitably conductive material may be used. The main dielectric body 7 is preferably constructed of a ceramic material, and the top support structure 8 is constructed of a low loss, low thermal expansion coefficient material such as a high purity alumina material. The respective ends of the top support structure 8 are bonded to the main dielectric body 7 and the bushing 9 using a low loss adhesive such as epoxy. The bottom support structure 10 is preferably constructed of a low loss and easily workable material such as polyethylene, and the spring 13 is a conventional spring. Further, the top support structure 8 and the bottom support structure 10 are dimensioned so that the main dielectric body 7 is disposed in the center of the cavity defined by the conductive housing 6. Of course, any other suitable materials may be used for constructing, assembling, and securing the main dielectric body 7, top support structure 8 and bottom support structure 10. Further, in alternative embodiments the main dielectric body 7, top support structure 8, and bottom support structure 10 may have other suitable shapes, and the spring 13 may be any other suitable device for biasing the main dielectric body 7 to remain in position.

Figure 3:
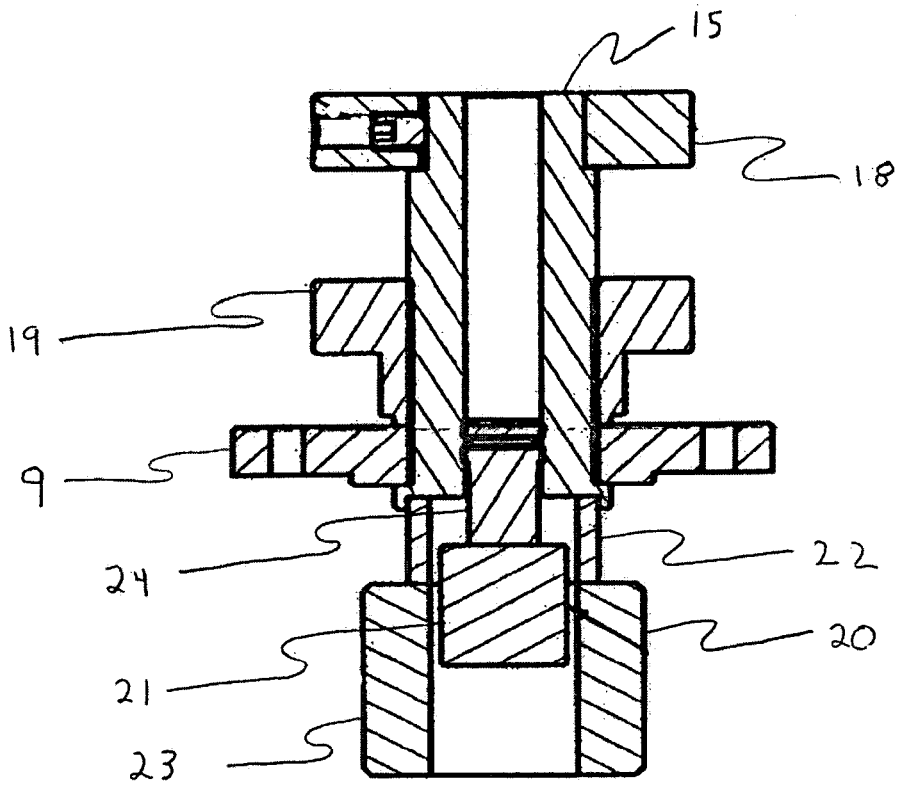
FIG. 3 is a plan view of a tuning assembly constructed in accordance with a preferred embodiment of the present invention.
Figure 4:
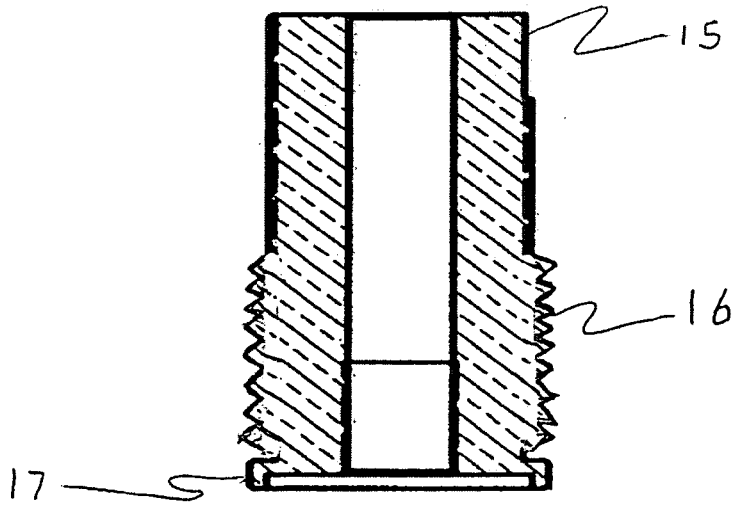
FIG. 4 is a plan view of a tuning shaft constructed in accordance with a preferred embodiment of the present invention.
Figure 5:
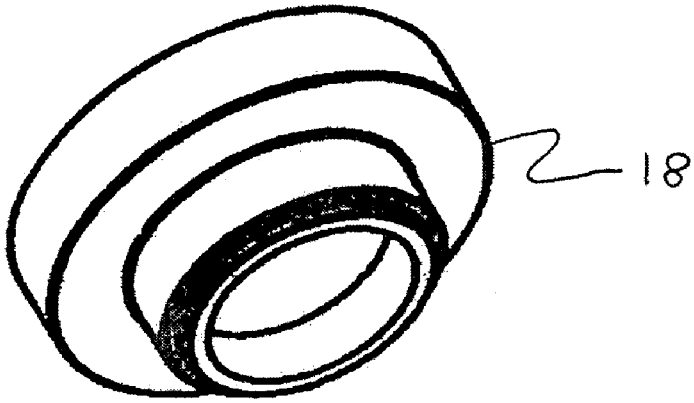
FIG. 5 is a plan view of a tuning knob constructed in accordance with a preferred embodiment of the present invention.

The resonator assembly 5 further includes a tuning assembly 14 partially disposed within the conductive housing 6. As illustrated in FIG. 2, the conductive housing 6 includes a top hole disposed co-axially with the bore of the main dielectric body 7. The tuning assembly 14 is disposed through the top hole such that elements of the tuning assembly 14 may be moved along the bore of the main dielectric body 7. As shown, the tuning assembly 14 includes the bushing 9 disposed through the top hole of the conductive housing 6. The bushing 9 is configured such that an exposed surface of the bushing 9 facing the cavity inside the conductive housing 6 is bonded to the top support structure 8, as previously noted. The bushing 9 has an internally threaded central hole. A cylindrically shaped tuning shaft 15 having a threaded internal bore is disposed through the central hole of the bushing 9, as illustrated in FIG. 3. The tuning shaft 15 is illustrated in FIG. 4. At least a lower portion of the tuning shaft 15 has external threads 16 configured to mate with the internal threads of the bushing 9 to facilitate the tuning shaft 15 moving through the bushing 9. Specifically, when the external threads 16 of the tuning shaft 15 are properly mated with the internal threads of the bushing 9, the tuning shaft 15 may be manually rotated in either a clockwise or a counterclockwise direction. The threads then cooperate to move the tuning shaft 15 co-axially through the bushing 9 in either a forward direction or a reverse direction. The lower end of the tuning shaft 15 also includes a circumferential flange 17 that locally increases the diameter of the tuning shaft 15, thereby preventing the tuning shaft 15 from passing through the central hole of the bushing 9 when traveling in a reverse direction. To assist an operator in manually rotating the tuning shaft 15, a tuning knob 18 is affixed to the tuning shaft 15. See, FIGS. 3 and 5. The tuning knob 18 is affixed to an upper end of the tuning shaft 15 and the tuning knob 18 is configured and dimensioned to be easily grasped by the operator.

In the preferred embodiment, the bushing 9 is constructed of brass. The tuning shaft 15 is constructed of a metal such as brass, and the tuning knob 18 is constructed of any suitable metallic or plastic material. Of course, in alternative embodiments the bushing 9, tuning shaft 15 and tuning knob 18 may be constructed of any other suitable material.

The tuning assembly 14 further includes a locking ring 19 having internal threads for mating with the external threads 16 of the tuning shaft 15. The locking ring 19 is disposed between the tuning knob 18 and the bushing 9. See, FIG. 3. The operator may rotate the locking ring 19 in a clockwise or counterclockwise direction to move the locking ring 19 forward or backward along the tuning shaft 15. An operator may move the locking ring 19 along the tuning shaft 15 until the locking ring 19 engages the bushing 9. The tuning shaft 15 can then be locked in position by rotating the locking ring 19 with sufficient force to frictionally seat the locking ring 19 against the bushing 9. By this arrangement, the mating threads of the tuning shaft 15 and the locking ring 19 prevent the tuning shaft 15 from any further rotation and axial movement. Similarly, the operator may unlock the tuning shaft 15 by rotating the locking ring 19 in a reverse direction such that the locking ring 19 is no longer frictionally engaged with the bushing 9. The operator is then free to rotate the tuning shaft 15 to move the tuning shaft 15 in the axial direction. The locking ring 19 is preferably constructed of brass, although any other suitable material may be used.

Figure 6:
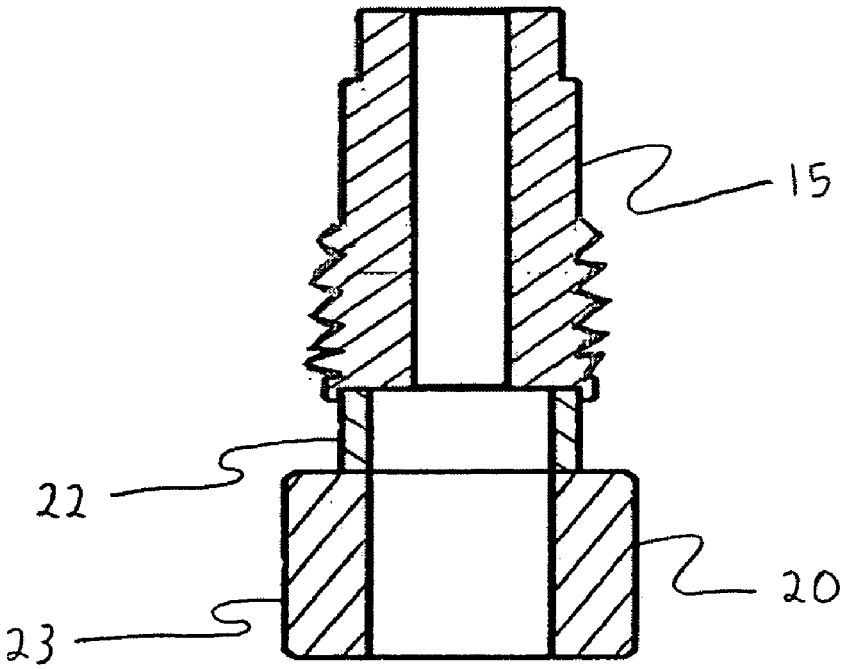
FIG. 6 is a plan view illustrating details of a coarse tuning assembly constructed in accordance with a preferred embodiment of the present invention.
Figure 7:
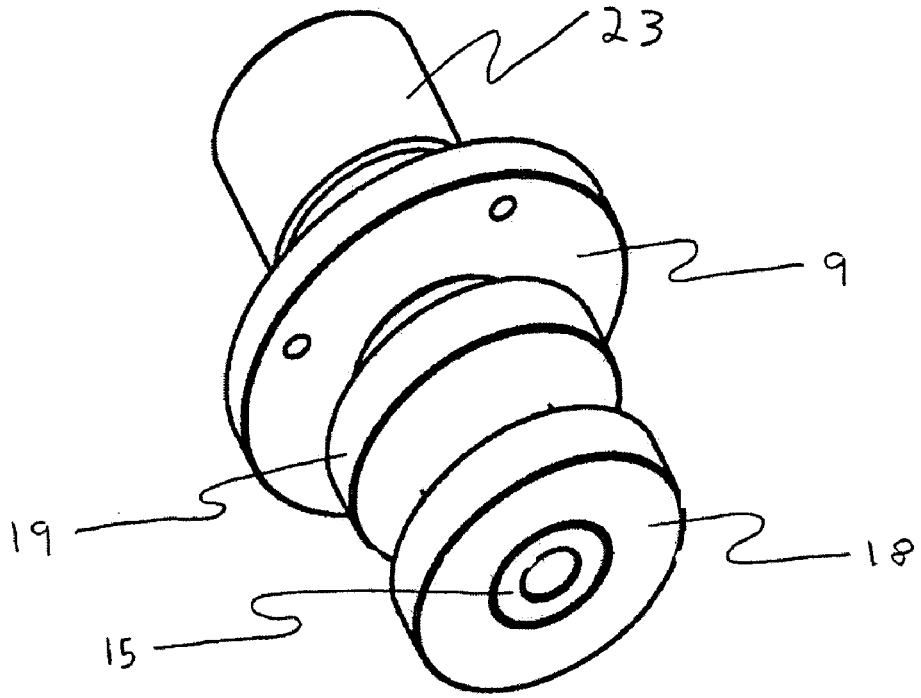
FIG. 7 is a perspective view of a tuning assembly constructed in accordance with a preferred embodiment of the present invention.

The tuning assembly 14 further includes a coarse adjustment tuner assembly 20 and a fine adjustment tuner assembly 21. The coarse adjustment tuner assembly 20 includes a connector 22 securely affixed to the bottom end of the tuning shaft 15. See, FIG. 6. In the preferred embodiment, the connector 22 has a cylindrical shape and is constructed of a low loss, low thermal expansion material such as alumina. As shown in FIG. 6, an upper end of the connector 22 is secured to the lower face of the tuning shaft 15. The lower end of the connector 22 is secured to a coarse tuner 23. The connector 22 is preferably bonded to the tuning shaft 15 and the coarse tuner 23 by a low loss adhesive such as epoxy, although any other suitable adhesive may also be used. A perspective view of a complete tuning assembly 14 is illustrated in FIG. 7.

The connector 22 and the coarse tuner 23 are dimensioned such that the coarse tuner 23 extends into the bore of the main dielectric body 7. See, FIG. 2. By this arrangement the position of the coarse tuner 23 may be adjusted within the bore of the main dielectric body 7 by manipulating the tuning shaft 15. The operator may thereby easily perform coarse tuning of the resonator assembly 5. Specifically, the coarse tuner 23 may be moved through the bore of the main dielectric body 7 by loosening the locking ring 19 and rotating the tuning shaft 15 in the manner described above in detail. The tuning shaft 15, and thus the coarse tuner 23, is thereby moved either forward or backward in the axial direction. The resonant frequency of the resonator assembly 5 is changed as the coarse tuner 23 is moved within the main dielectric body 7. Thus, the operator adjusts the position of the coarse tuner 23 within the main dielectric body 7 until the resonator assembly 5 approximately reaches a desired resonant frequency. In the preferred embodiment, moving the coarse tuner 23 can adjust the resonant frequency through a range of 1 to 70 MHz, or even more, depending on the size and magnitude of movement of the coarse tuner 23.

Figure 8:
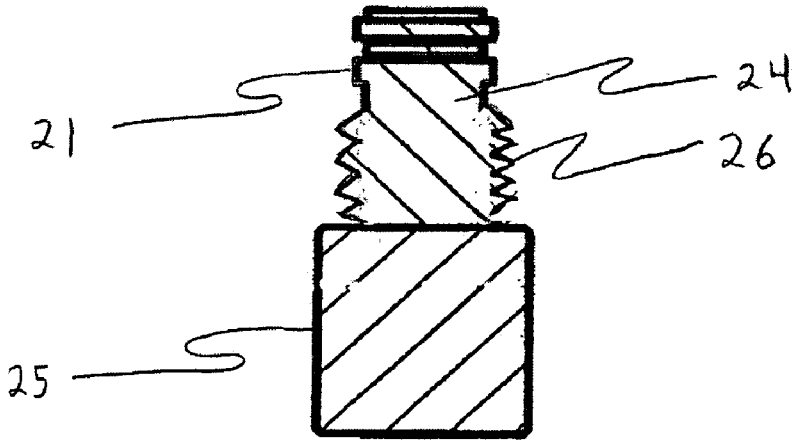
FIG. 8 is a plan view of a fine tuning assembly constructed in accordance with a preferred embodiment of the present invention.

More precise tuning of the resonator assembly 5 is accomplished using the fine adjustment tuner assembly 21. As shown in FIGS. 2 and 3, the fine adjustment tuner assembly 21 is disposed co-axially through the bore of the coarse adjustment tuner assembly 20. The fine adjustment tuner assembly 21 includes a self locking, threaded tuning adjustment screw 24 affixed to a fine tuner 25. See, FIG. 8. The tuning adjustment screw 24 has external threads 26 configured to mate with the internal threads in the bore of the tuning shaft 15. The foregoing arrangement allows the operator to perform fine tuning of the resonant frequency after performing the coarse tuning procedure previously discussed. Specifically, the operator can precisely tune the resonator assembly 5 by manually rotating the tuning adjustment screw 24 with an appropriate tool, thereby moving the tuning adjustment screw 24 and the fine tuner 25 co-axially along the bore of the coarse tuner 23. By this arrangement, the resonator assembly 5 may be precisely tuned to a desired resonant frequency by carefully adjusting the position of the fine tuner 25 within the coarse tuner 23. In the preferred embodiment, moving the fine tuner 25 will adjust the resonant frequency by a range of 1 to 400 KHz, based on the size and magnitude of movement of the fine tuner 25.

In the preferred embodiment the coarse tuner 23 and the fine tuner 25 are constructed of a ceramic material. The main dielectric body 7, the coarse tuner 23 and the fine tuner 25 may all be constructed of the same ceramic material, or may be constructed of different ceramic materials. Also, the top support structure 8 (affixed to the main dielectric body 7), the connector 22 (affixed to the coarse tuner 23), and the tuning adjustment screw 24 (affixed to the fine tuner 25), are each constructed of materials having a relatively high thermal conductivity. By this arrangement, heat generated inside the main dielectric body 7 is readily conducted to the conductive housing 6, so that average power handling characteristics of the resonator assembly 5 can be stabilized. Additionally, as shown in FIG. 2 and previously discussed, the coarse tuner 20 and the fine tuner 21 are physically coupled together and are jointly carried by the bushing 9. The main dielectric body 7 is bonded to the top support structure 8 which is mounted to the bushing 9. By this arrangement the coarse tuner 20, the fine tuner 21 and the main dielectric body 7 are each coupled to the bushing 9, thereby minimizing the relative movement among these three resonating components during thermal expansion and contraction of the resonator assembly 5. When operating in the 761 to 776 MHz frequency band, for example, the resonator assembly 5 of the present invention advantageously provides frequency stability to within +/−40 kHz over the operating temperature range.

By way of further example, the resonator assembly may be used in a 2000 MHz frequency band application. In such an application the resonator assembly 5 should be adjustable throughout the frequency band of 2030 MHz to 2090 MHz, and can be precisely tuned to a desired frequency within that band in the manner previously described. Specifically, the operator manually loosens the locking ring 19 by rotating the locking ring 19 in a direction that will disengage the locking ring 19 from the bushing 9. The operator then rotates the tuning knob 18 of the tuning shaft 15 such that the threads of the bushing 9 and the tuning shaft 15 move the tuning shaft 15 in a desired direction through the bushing 9. The coarse tuner 23 and fine tuner 25 are thereby co-axially moved along the bore of the main dielectric body 7. The operator manipulates the tuning shaft 15 until the resonator assembly 5 achieves a resonant frequency within a predetermined range of a desired resonant frequency. The operator then rotates the locking ring 19 until the locking ring 19 frictionally engages the bushing 9, thereby preventing further movement of the tuning shaft 15. The operator then manipulates the tuning adjustment screw 24 of the fine adjustment tuner assembly 21 to more precisely adjust the resonant frequency to reach the desired resonant frequency. The self-locking tuning adjustment screw 24 then secures the fine tuner 25 within the main dielectric body 7 to maintain the desired resonant frequency.

One skilled in the art will appreciate that the specific dimensions of the components constituting the resonator assembly 5 are selected in accordance with particular desired performance requirements. When operating in the 700–800 MHz frequency band, the diameter of the main dielectric body 7 is approximately 2.617 inches, with a central bore having an approximate diameter of 1.4 inches, and a length of approximately 1.9 inches. The bottom support structure 10 has a diameter of approximately 1.65 inches, and a length of approximately 1.17 inches. Preferably, the diameter of the coarse tuner 23 is approximately 1.3 inches, with a central bore having an approximate diameter of 0.68 inches, and a length of approximately 0.079 inches. The connector 22 has a diameter of approximately 0.88 inches and a length of approximately 0.53 inches. The fine tuner 25 has a preferred diameter of approximately 0.58 inches, and a length of approximately 0.625 inches. One skilled in the art will readily appreciate that the specific dimensions discussed above are subject to change to meet different resonator performance requirements. For example, when operating within the 2000 MHz frequency band, the tuning elements are proportionally smaller.

The previously described resonator assembly 5 can be used for a variety of applications. For example, the resonator assembly 5 can be used in a microwave filter assembly for a communication system. Such a filter assembly may include one resonator assembly 5, or plural resonator assemblies 5 coupled together. In such a plural system the resonator assemblies 5 are inductively coupled and capacitively cross-coupled in a predetermined fashion to achieve the desired performance. The filter is then incorporated into conventional communication equipment used for sending, receiving or processing the communication signals. Such communication equipment includes amplifiers and power combiners. For example, it is common to combine signals from two or more channels to form one output signal that is broadcast from an antenna. In the 761 to 776 MHz range, the channels are 12.5 kHz wide, and the spacing between adjacent channels is as narrow as 150 kHz. Tuning the resonator assemblies 5, and thus the combiner, with such a high degree of precision is readily accomplished with the present invention. Of course, the resonator assembly 5 can also be used in other communication equipment, and can also be used in applications other than filters, amplifiers and combiners in a communication system.

Alternative embodiments of the present invention could include three or more tuning slugs, instead of the previously discussed two tuning slugs. Additionally, the shapes, dimensions, locations and materials of the elements described above can also be modified while remaining within the scope of the invention.

Although specific embodiments of the present invention have been previously described in detail, it will be understood that this description is merely for illustrative purposes. Various modifications of and equivalent structure corresponding to the disclosed aspects of the preferred embodiments in addition to those described above may be made by those skilled in the art without departing from the present invention which is defined in the following claims. The scope of the claims is to be accorded the broadest interpretation so as to encompass such modifications and equivalent structures.

What is claimed is:

1. A resonator assembly, comprising:

a conductive housing defining a cavity;

a resonator disposed within the cavity and having a longitudinal bore;

a coarse tuning assembly having a longitudinal bore, said coarse tuning assembly being movably disposed along the bore of said resonator; and a fine tuning assembly movably disposed along the bore of said coarse tuning assembly, wherein said coarse tuning assembly is mechanically coupled to said fine tuning assembly such that movement of said coarse tuning assembly causes movement of said fine tuning assembly.

2. The resonator assembly recited in claim 1, wherein said coarse tuning assembly is associated with a coarse tuning adjustment mechanism, and wherein said fine tuning assembly is associated with a fine tuning adjustment mechanism.

3. The resonator assembly recited in claim 2, wherein said fine tuning assembly is movable independently of said coarse tuning assembly.

4. The resonator assembly recited in claim 1, further comprising a tuning locking mechanism for locking said coarse tuning assembly.

5. The resonator assembly recited in claim 1, further comprising a first support contacting said resonator, and a second support contacting said resonator.

6. A resonator assembly, comprising:

a conductive housing defining a cavity;

resonator means for resonating at a predetermined frequency, said resonator means being disposed within the cavity;

coarse tuning means for tuning said resonator means, said coarse tuning means having longitudinal bore and being movable along a longitudinal bore of said resonator means; and fine tuning means for tuning said resonator means, said fine tuning means being movably disposed along the longitudinal bore of said coarse tuning means, wherein said coarse tuning means is mechanically coupled to said fine tuning means such that movement of said coarse tuning means causes movement of said fine tuning means.

7. The resonator assembly recited in claim 6, wherein said coarse tuning means is associated with a coarse tuning adjustment mechanism, and wherein fine tuning means is associated with a fine tuning adjustment mechanism.

8. The resonator assembly recited in claim 7, wherein said fine tuning means is movable independently of said coarse tuning means.

9. A filter, comprising:

at least one resonator assembly, said resonator assembly having:

a conductive housing defining a cavity;

a resonator disposed within the cavity and having a longitudinal bore;

a coarse tuning assembly having a longitudinal bore, said coarse tuning assembly being movably disposed along the bore of said resonator; and a fine tuning assembly movably disposed along the bore of said coarse tuning assembly, wherein said coarse tuning assembly is mechanically coupled to said fine tuning assembly such that movement of said coarse tuning assembly causes movement of said fine tuning assembly.

10. The filter recited in claim 9, wherein said coarse tuning assembly is associated with a coarse tuning adjustment mechanism, and wherein said fine tuning assembly is associated with a fine tuning adjustment mechanism.

11. The filter recited in claim 10, wherein said fine tuning assembly is movable independently of said coarse tuning assembly.

12. A communication system, comprising:

communication equipment for performing at least one of sending and receiving a communication signal;

at least one filter, said filter including:

at least one resonator assembly, said resonator assembly having:

a conductive housing defining a cavity;

a resonator disposed within the cavity and having a longitudinal bore;

a coarse tuning assembly having a longitudinal bore, said coarse tuning assembly being movably disposed along the bore of said resonator; and a fine tuning assembly movably disposed along the bore of said coarse tuning assembly, wherein said coarse tuning assembly is mechanically coupled to said fine tuning assembly such that movement of said coarse tuning assembly causes movement of said fine tuning assembly.

13. The communication system recited in claim 12, wherein said coarse tuning assembly is associated with a coarse tuning adjustment mechanism, and wherein said fine tuning assembly is associated with a fine tuning adjustment mechanism.

14. The communication system recited in claim 13, wherein said fine tuning assembly is movable independently of said coarse tuning assembly.

* * * * *